United States Patent [19]

Zmijewski

[11] 4,016,919

[45] Apr. 12, 1977

[54] BREATH DEFLECTOR

[76] Inventor: Emma Zmijewski, 268 17th St., Brooklyn, N.Y. 11215

[22] Filed: Nov. 7, 1974

[21] Appl. No.: 521,748

[52] U.S. Cl. ..... 160/130; 160/229 R; 5/329; 248/459

[51] Int. Cl.[2] ..... A47C 21/00

[58] Field of Search ..... 160/129, 130, 135, 229, 160/230; 5/359, 329; 248/459, 460

[56] References Cited

UNITED STATES PATENTS

| | | | |
|---|---|---|---|
| 930,554 | 8/1909 | Moody | 5/329 |
| 1,635,573 | 7/1927 | Bertram | 160/135 |
| 1,944,696 | 1/1934 | Reichl | 160/135 |
| 2,208,713 | 7/1940 | Wilhelm | 5/329 |
| 2,374,156 | 4/1945 | Wellman | 160/229 R |
| 2,744,519 | 5/1956 | Means | 160/229 R |
| 2,806,809 | 9/1957 | Schuh | 160/230 |
| 3,160,199 | 12/1964 | Culpepper | 160/130 |
| 3,195,850 | 7/1965 | Steiner | 248/459 |
| 3,586,279 | 6/1971 | Benson | 248/459 |

FOREIGN PATENTS OR APPLICATIONS

| | | | |
|---|---|---|---|
| 448,091 | 4/1948 | Canada | 5/329 |

*Primary Examiner*—Paul R. Gilliam
*Assistant Examiner*—Victor N. Sakran

[57] ABSTRACT

A breath deflector comprised of a surface sheet having end edges and side edges divided into four areas by three folding lines connecting the side edges of the surface sheet wherein the four areas are foldably connected to each other.

5 Claims, 4 Drawing Figures

Fig. 1
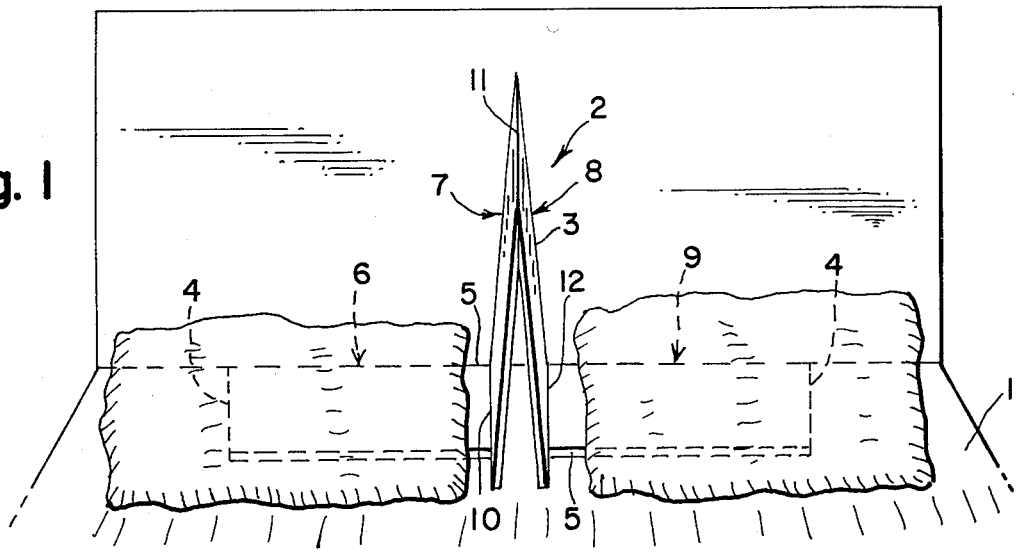
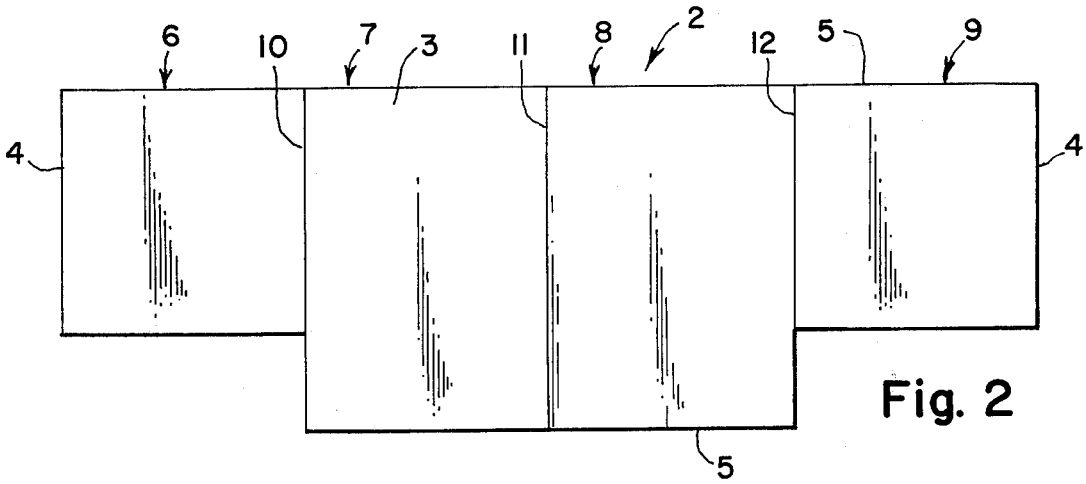
Fig. 2
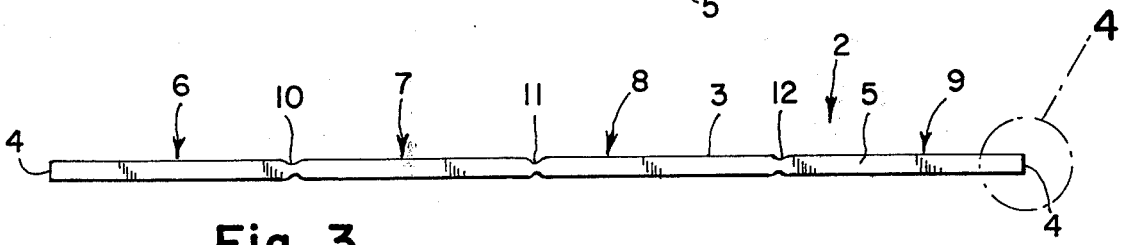
Fig. 3
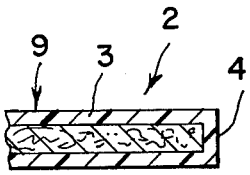
Fig. 4

BREATH DEFLECTOR

This invention relates to a new and useful invention for breath deflectors, and has for its primary object the provision of a means for preventing the occupants of a bed from directly breathing, inhaling the breath of the other, or coughing upon the other person in the bed.

Another object of this invention is to provide a breath deflector which will be simple, durable and efficient and which may be manufactured and sold at a comparably low cost.

Still another object of this invention is to provide a breath deflector which may be folded up and placed in a convenient place when not in use.

A still further object of this invention is to provide a device which forms a vertical partition between pillows on a bed which may be readily applied to the bed and removed therefrom, the device having no fixed connection with the bed.

A still further object of this invention is to provide a device which may be easily kept in a sanitary condition.

With these objects in view the breath deflector contemplated by this invention is comprised of a surface sheet having end edges and side edges; divided into four areas by three folding lines connecting the side edges of the surface sheets wherein the four areas are foldably connected to each other.

The invention is fully disclosed by way of example in the following description and in the accompanying drawings in which:

FIG. 1 is a perspective view illustrating the use of the device;

FIG. 2 is a plan view of the device; and

FIG. 3 is an edge view of the device completely extended;

FIG. 4 is a section of edge 4 in FIG. 3.

Reference to these views will now be made by use of like characters which are employed to designate the corresponding parts throughout.

The bed on which the device is to be used is indicated in general by numeral 1 in FIG. 1.

The breath deflector device of this invention in general is designated by the numeral 2. The breath deflector is comprised of a surface sheet 3. This surface sheet may be constructed of any convenient type material, preferably the material is flexible, clear, washable and/or fireproof. The material may also have designs on it to make it attractive in use.

The surface sheet is preferably rectangular in shape, although this invention contemplates the use of any shaped surface sheet which will fulfill the purpose contemplated by this invention.

The surface sheet generally has end edges 4 and side edges 5. The surface sheet is divided into four areas 6, 7, 8, and 9. These four areas are created by three folding lines 10, 11, and 12, connecting the side edges of the surface sheet. These folding lines create four areas which are foldably connected to each other along these folding lines.

By the use of the term "folding lines" it is contemplated that any connecting means which will fulfill the purpose of foldably connecting the adjacent areas to each other can be used. For example, hinges, connecting flexible material, etc. may fulfill the purpose of these folding lines.

The surface sheet may be constructed of a fibrous material, plastic material, etc.

Preferably the two end areas 6 and 9 are of equal size and shape and the two middle areas 7 and 8 are also of equal size and shape.

In use the two end areas are placed underneath the pillows of the bed, i.e., area 6 is placed under the left pillow and area 9 is placed under the right pillow. Surface areas 7 and 8 are folded in such a manner so as to provide a cough buffer, breath deflector, etc. between the persons lying on the left pillow and the right pillow.

Frequently the occupants of a double bed are unwilling to face each other because of the distastefulness of inhaling each others breath, coughing upon each other, etc. Consequently both occupants must face the same direction at the same time, and the position of each occupant is determined by the position of the other, rather than voluntarily. These limitations on the use of a double bed by two occupants frequently result in the use of twin beds or even separate bedrooms. It is evident that the device of this invention provides a much simpler and less expensive solution to the problem. Also, the device may be removed and set aside when not in use in order not to impair the made up appearance of the bed. The device may be easily folded and stored away in a convenient place.

Although a specific embodiment of the invention has been illustrated and described it will be understood that various alterations in the details of construction, material, etc. may be made without departing from the scope of the invention as indicated by the appended claims.

Having thus described the invention, what I claim as new is:

1. A collapsible breath deflector for placing between two adjacent pillows on a bed comprising:

a rectangular surface sheet having end edges and side edges;

the end edges of a length substantially equivalent to the pillow width;

three folding lines connecting the side edges to form two end and two middle rectangular areas foldably connected to each other;

the two end areas are of equal size and shape;

the two middle areas are of equal size and shape;

the end areas and middle areas of a size and shape such that when the two end areas are placed underneath the two pillows adjacent to each other the two middle areas fold to a height above the bed and at an angle to the bed sufficient to deflect, but not reflect, a person's breath lying on one pillow from a person lying on the adjacent pillow; whereby the breath deflector can be folded and collapsed flat so that it can be easily stored.

2. The breath deflector of claim 1, wherein the surface sheet is made of plastic material.

3. The breath deflector of claim 1, wherein the surface sheet is clear.

4. The breath deflector of claim 1, wherein the surface sheet is washable.

5. The breath deflector of claim 1, wherein the surface sheet is constructed of fireproof material.

* * * * *